US010550735B2

(12) United States Patent
Petrov

(10) Patent No.: US 10,550,735 B2
(45) Date of Patent: Feb. 4, 2020

(54) CAMSHAFT ARRANGEMENT

(71) Applicant: Volvo Car Corporation, Göteborg (SE)

(72) Inventor: Peter Petrov, Angered (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 16/365,768

(22) Filed: Mar. 27, 2019

(65) Prior Publication Data

US 2019/0331008 A1 Oct. 31, 2019

(30) Foreign Application Priority Data

Apr. 26, 2018 (EP) ..... 18169508

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34433* (2013.01)

(58) Field of Classification Search
CPC ..... F01L 1/047; F01L 1/3442; F01L 2001/34426; F01L 2001/0475; F01L 2001/0471; F01L 2001/34433; F01L 2001/3443
See application file for complete search history.

(56) References Cited

U.S. PATENT DOCUMENTS

2013/0068180 A1 3/2013 Heywood et al.
2014/0299081 A1* 10/2014 Nakata ..... F02D 13/02 123/90.15

FOREIGN PATENT DOCUMENTS

DE 102011012020 A1 8/2012
JP H0211812 A 1/1990

OTHER PUBLICATIONS

Sep. 5, 2018 European Search Report issue on International Application No. EP18169508.

* cited by examiner

*Primary Examiner* — Zelalem Eshete
(74) *Attorney, Agent, or Firm* — Clements Bernard Walker; Christopher L. Bernard

(57) ABSTRACT

A camshaft arrangement comprising a camshaft, a vane-type camshaft phaser attached to a first end of the camshaft, a valve actuating arrangement and an oil control valve. The oil control valve comprises an elongated valve member arranged centrally inside the camshaft. The elongated valve member can be adjusted in a longitudinal direction of the camshaft to control the oil flow to the vane-type camshaft phaser by actuation of an actuator. The valve actuating arrangement comprises a first valve actuating configuration attached to the camshaft and a second valve actuating configuration comprising an actuation arm connected to the actuator. The first valve actuating configuration is arranged to be actuated by the actuation arm of the second valve actuating configuration.

15 Claims, 3 Drawing Sheets

CAMSHAFT ARRANGEMENT

CROSS-REFERENCE TO RELATED APPLICATION

The present disclosure claims the benefit of priority of co-pending European Patent Application No. 18169508.1, filed on Apr. 26, 2018, and entitled "CAMSHAFT ARRANGEMENT," the contents of which are incorporated in full by reference herein for all purposes.

TECHNICAL FIELD

The invention relates to a camshaft arrangement comprising a camshaft, a vane-type camshaft phaser attached to a first end of the camshaft, a valve actuating arrangement, and an oil control valve for the vane-type camshaft phaser. The invention also relates to an internal combustion engine comprising such camshaft arrangement, and to a vehicle comprising such internal combustion engine.

BACKGROUND ART

Camshaft phasers for varying the timing of opening and closing of intake and exhaust valves in internal combustion engines are well known. Typically, the camshaft is driven by the crankshaft via a belt or similar. By arranging the belt around a part of the camshaft that can be rotationally adjusted (advanced or retarded) in relation to the camshaft the rotational phasing between the two shafts can be adjusted.

A common type of camshaft phaser is disclosed in e.g. US2007/0560539, DE102013212935, US2014/0150742 and WO2017/162233. This type is a so-called vane-type camshaft phaser generally comprising a plurality of outwardly-extending vanes on a rotor interspersed with a plurality of inwardly-extending lobes on a stator, forming alternating advance and retard chambers between the vanes and lobes. Engine oil is supplied via an oil control valve to either the advance or retard chambers to change the angular position of the rotor relative to the stator, and consequently to change the angular position of the camshaft relative to the crankshaft.

As shown in e.g. DE102013212935 the oil control valve may form an elongated valve member arranged centrally inside the camshaft, where the valve member can be adjusted in a longitudinal direction of the camshaft so as to control the oil flow. The oil control valve member is controlled by means of an actuator arranged at the end part of the crankshaft, which actuator comprises a solenoid and a press pin adapted to press the valve member in an inwards direction. A spring arranged inside of the valve member is adapted to press the valve member in the opposite, outwards direction.

Some form of sealed cover is arranged around the oil control valve at the end part of the camshaft to prevent dirt etc. to enter the system and to avoid oil drainage/spillage but also to provide support for the actuator itself. Sealing is particularly important for avoiding exposing a dry belt that drives the camshaft to any oil.

Partly for the reason of reducing the risk of oil leakage, US2014/0366821 suggests the use of camshaft phasers actuated by an electric motor as an alternative to vane-type camshaft phasers. Long term experience of such devices appears, however, not yet to have been built up.

Conventional vane-type camshaft phasers with centrally mounted actuator have a disadvantage in some applications in that the actuator require a significant space at the end part of the camshaft, i.e. outside of the engine at the front thereof. This may be a problem, in particular for a passenger car having a transversely arranged engine where there is not much space at the front and end sides of the engine (which in such a case face towards the sides of the car).

In short there is thus a general need for improvements in the field of camshaft phaser arrangements.

SUMMARY

An object of this invention is to provide a camshaft arrangement comprising a vane-type camshaft phaser that addresses the problems described above.

The invention concerns a camshaft arrangement comprising a camshaft, a vane-type camshaft phaser attached to a first end of the camshaft, a valve actuating arrangement, and an oil control valve. The oil control valve comprises an elongated valve member arranged centrally inside the camshaft, where the elongated valve member can be adjusted in a longitudinal direction of the camshaft so as to control the oil flow to the vane-type camshaft phaser. The valve actuating arrangement comprises a first valve actuating configuration attached to the camshaft and a second valve actuating configuration comprising an actuation arm connected to an actuator. The first valve actuating configuration is arranged to be actuated by the actuation arm of the second valve actuating configuration, thereby adjusting the elongated valve member.

One advantage with such a design is that the build length of the engine can be reduced. There is no need for an actuator holding bracket and sealing ring arrangement for connection to the camshaft phaser outside of the engine. According to one example embodiment, said actuator is comprised in said camshaft arrangement.

In a further development of the camshaft arrangement, the first valve actuating configuration comprises an actuation ring mounted around the camshaft and an actuation ring member being attached to the actuation ring arranged to run through the camshaft. By having an actuation ring mounted around the camshaft and an actuation ring member being attached to the actuation ring that runs through the camshaft, the first valve actuating configuration rotates with the camshaft and can glide along the camshaft. Thus, this construction ensures that the actuation ring member can interact with the oil control valve at all times.

In a further development of the camshaft arrangement, the actuation ring member comprises an actuation pin attached to the actuation ring. The camshaft comprises longitudinal openings for the actuation pin. By arranging longitudinal openings in the camshaft that the pin can run through, the range of motion of the actuation pin can be precisely determined.

In a further development of the camshaft arrangement, the actuation arm comprises an actuation arm member arranged to interact with the first valve actuating configuration. The actuation arm member will transfer the movement of the actuator via the actuation arm to the first valve actuating configuration. The actuation arm member is static in relation to the first valve actuating configuration and can be arranged to glide against the camshaft or be arranged at a distance from the camshaft. Preferably, it is arranged such that it ends a distance from the camshaft.

In a further development of the camshaft arrangement, the actuation arm member comprises a bearing surface adapted to glide against the actuation ring. The actuation arm member is not attached to the actuation ring but will instead be separate from the actuation ring. When actuating the actuation ring the actuation arm member will glide against the rotating actuation ring while at the same time moving the actuation ring in axial direction. In one alternative, the bearing surface is flat. In another alternative, the bearing surface is convex. An actuation arm member having a convex bearing surface may allow oil to amass between the bearing surface and the actuation ring, thereby creating oil film and improving lubrication between the two surfaces. Also, the total surface area of the actuation arm member engaging with the actuation ring is reduced leading to less friction between the two. Furthermore, convex shape provides for less tolerance sensitivity for the position of the arm against the ring.

In a further development of the camshaft arrangement, the angular extension of the actuation arm member is less than 180°, more specifically less than 90°, even more specifically less than 30°. The actuation arm member encompasses at least part of the camshaft and may have a shape of a partial circle to match the shape of the camshaft. The actuation arm member may comprise a fork.

In a further development of the camshaft arrangement, the oil control valve comprises an oil control valve engagement member arranged to interact with the actuation ring member of the first valve actuating configuration.

The invention also relates to an internal combustion engine comprising a camshaft arrangement according to the above and to a vehicle comprising such a combustion engine.

The actuator can be placed outside of the cam cover. With the first valve actuating arrangement attached to the camshaft instead of being positioned outside of the engine, the actuator can also be positioned in places within the engine room where there is available unused space today.

BRIEF DESCRIPTION OF THE DRAWINGS

In the description of the invention given below reference is made to the following figure, in which.

DESCRIPTION OF EMBODIMENTS

Figure 1:
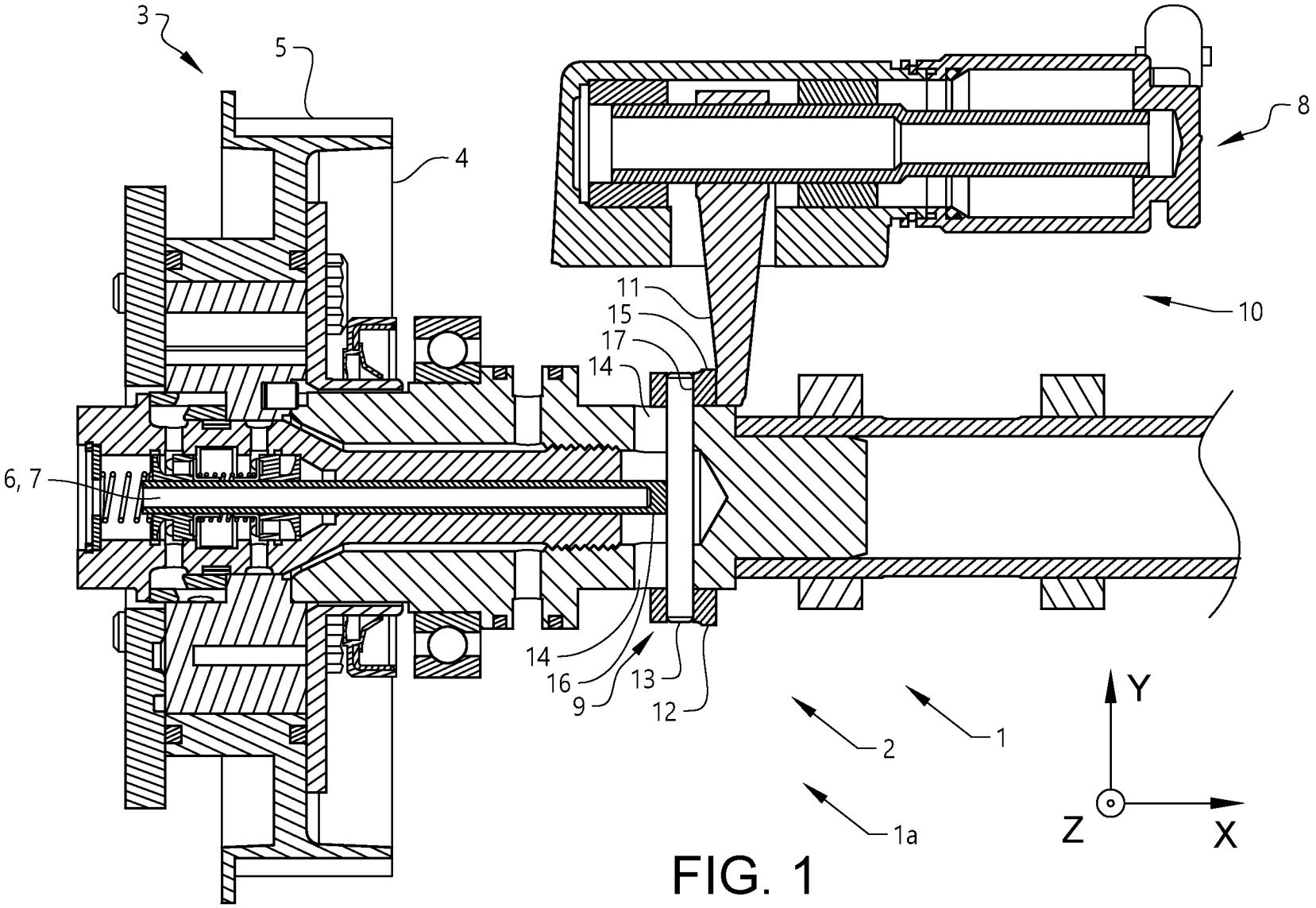
FIG. 1 schematically shows a cross-sectional view of a camshaft arrangement according to the invention, FIG. 2 schematically shows an exploded view of a camshaft arrangement according to the invention, and FIG. 3 schematically shows a cross-sectional view of a combustion engine with a camshaft arrangement according to the invention.

FIG. 1 schematically shows a cross-sectional view of a camshaft arrangement 1 according to the invention. The camshaft arrangement 1 comprises a valve actuating arrangement 2, a camshaft 1*a* having an extension in a longitudinal direction X and at a first end 3 of the camshaft 1*a*, a vane-type camshaft phaser 4 is attached to an input sprocket 5 of the camshaft 1*a*. The input sprocket 5 is connected to the crankshaft by a timing belt or tinning chain (not shown). The function of the vane-type camshaft phaser 4 and its attachment to the camshaft 1*a* are known in the art. An oil control valve 6 which comprises an elongated valve member 7 is arranged centrally inside the camshaft 1*a*. The elongated valve member 7 can be adjusted in a longitudinal direction of the camshaft 1*a* so as to control an oil flow to the vane-type camshaft phaser 4 by actuation of an actuator 8 in order to change the timing between the camshaft 1*a* and a crankshaft of a combustion engine.

The valve actuating arrangement 2 comprises a first valve actuating configuration 9 attached to the camshaft 1*a* and a second valve actuating configuration 10. The second valve actuating configuration comprises an actuation arm 11 and an actuator 8, where the actuation arm is connected to the actuator 8. The first valve actuating configuration 9 is arranged to be actuated by the actuation arm 11 of the second valve actuating configuration 10. The first valve actuating configuration 9 is attached to the camshaft 1*a* and thus rotates with the camshaft 1*a*. The first valve actuating configuration 9 comprises an actuation ring 12 mounted around the camshaft 1*a* and is attached to the camshaft 1*a* by means of that an actuation ring member 13 is arranged to run through the camshaft 1*a* and the actuation ring 12. The actuation ring member 13 is in the present example an actuation pin. The actuation pin runs in longitudinal openings 14 arranged on opposite sides of the camshaft 1*a*. The first valve actuating configuration 9 thus rotates with the camshaft 1*a* and can glide a distance along the camshaft 1*a* corresponding to the length of the longitudinal openings 14. The longitudinal openings 14 have essentially semi-circular ends and each longitudinal opening has a length of approximately 2-10 mm, more specifically approximately 4 mm, as measured between centres of radii of the semi-circular ends of the longitudinal openings. Thus, the first valve actuating configuration can move approximately 2-10 mm along the camshaft 1*a*, more specifically approximately 4 mm.

To the actuation arm 11 of the second valve actuating configuration 10, an actuation arm member 15 is attached. In the example of FIG. 1, the actuation arm member 15 is positioned in a vertical direction above the camshaft 1*a*. The actuation arm member 15 can be either in a position such that it glides against the camshaft 1*a* when the camshaft 1*a* rotates or in a position such that it does not lie against the camshaft 1*a* and a gap is present between the camshaft 1*a* and the actuation arm member 15. The actuation arm member 15 abuts the actuation ring 12 of the first valve actuating configuration 9 as long as the actuator 8 is powered. The actuator 8 moves the actuation arm 11 and thus the actuation arm member 15 in a longitudinal direction along the camshaft 1*a* thereby moving the first valve actuating configuration 9. The first valve actuating configuration 9 are arranged to actuate an oil control valve engagement member 16 in order to move the oil control valve 6 between a first position and a second position. The actuation arm member 15 comprises a bearing surface 17 adapted to glide against the rotating actuation ring 12 when the second valve actuating configuration 10 actuates the first actuating configuration. The bearing surface 17 may be convex.

Figure 2:
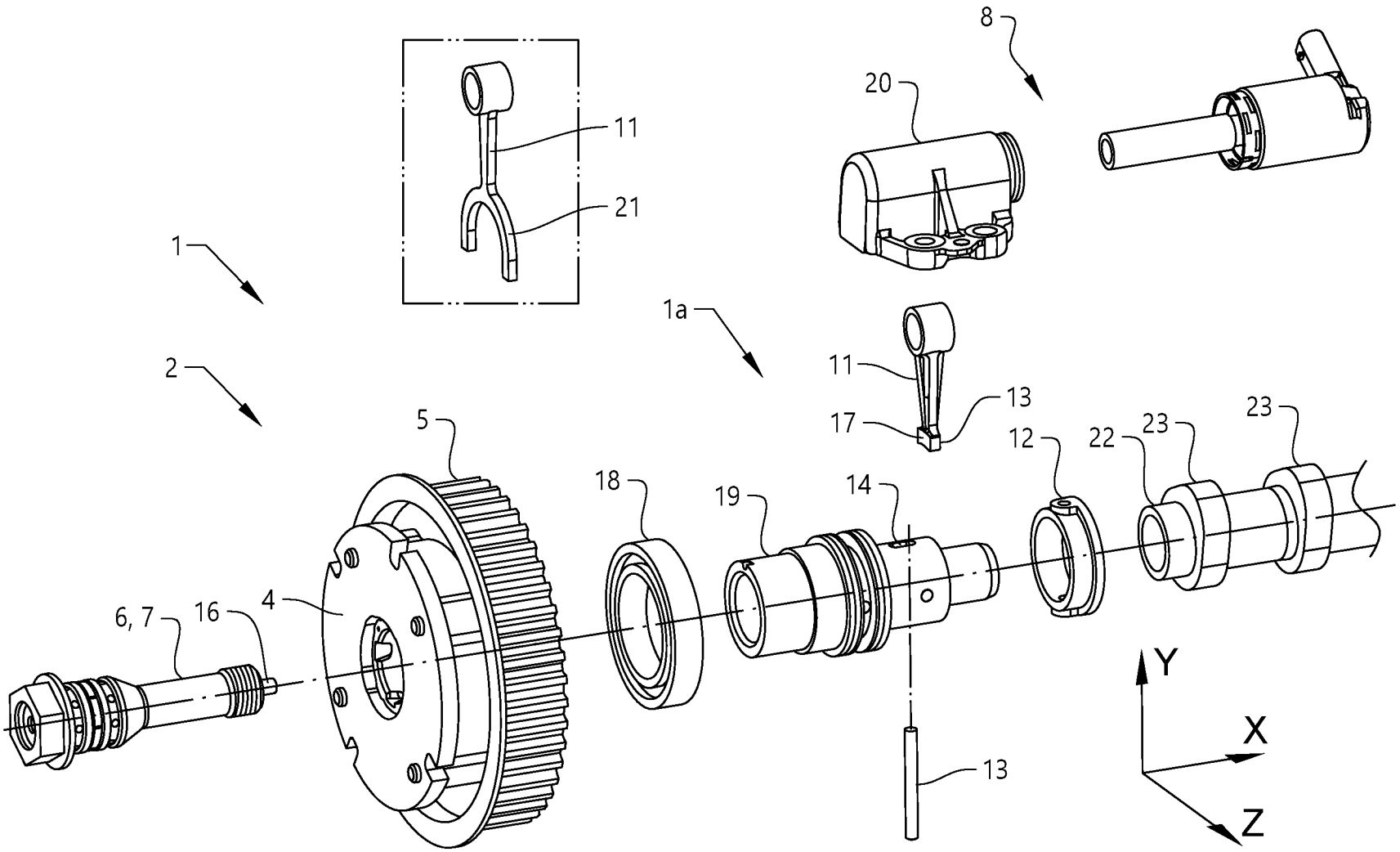

FIG. 2 schematically shows an exploded view of a camshaft arrangement 1 according to the invention. From left to right, FIG. 2 shows the oil control valve 6 with the oil control valve engagement member 16 extending from it. The oil control valve engagement member 16 is an extension of the elongated valve member 7 or valve piston inside the oil control valve 6. Next, FIG. 2 shows the vane-type camshaft phaser 4, a support bearing 18 for supporting the camshaft 1*a* and a camshaft end section 19 arranged to engage with the camshaft phaser 4 and in which the oil control valve 6 is mounted. On the camshaft end section 19, the first valve actuating configuration 9, i.e. actuation ring 12 and actuation ring member 13, are attached. The camshaft end section 19 comprises longitudinal openings 14 through which the actuation pin runs attaching the actuating ring 12 to the camshaft 1*a* and in which the actuation pin can run in a direction along the camshaft 1*a* when actuated. As described above, the actuation pin of the first valve actuating configuration 9 is arranged to actuate the oil control valve engagement member 16 and thereby the oil control valve 6. Further, the second valve actuating configuration 10 are shown, comprising the actuator 8, an actuator housing 20 and the actuation arm 11 with the actuation arm member 15 attached to it. The actuation arm member 15 has a convex bearing surface 17 arranged to engage with the actuation ring. The angular extension of the actuation arm member 15 may be less than 180°, more specifically less than 90°, even more specifically less than 30°. In the example of FIG. 2, the angular extension is approximately 15°. In the inset figure, an alternative actuation arm member 15 can be seen. The alternative actuation arm member comprises a fork 21 glidably arranged on the camshaft 1*a* or arranged at a distance from the camshaft 1*a* as with the alternative example described above. A further alternative for the actuation arm member 15 is to have a circular actuation arm member, i.e. a ring enclosing the camshaft 1*a*.

In the example of FIG. 2, the actuator 8 is a solenoid valve. The actuation arm 11 is attached to the actuator 8 such that its movement is restricted to movement in the longitudinal direction X. The actuator 8 can alternatively be an electric motor or a hydraulic actuator. FIG. 2 lastly shows the camshaft main section 22 with the first two cams 23.

Figure 3:
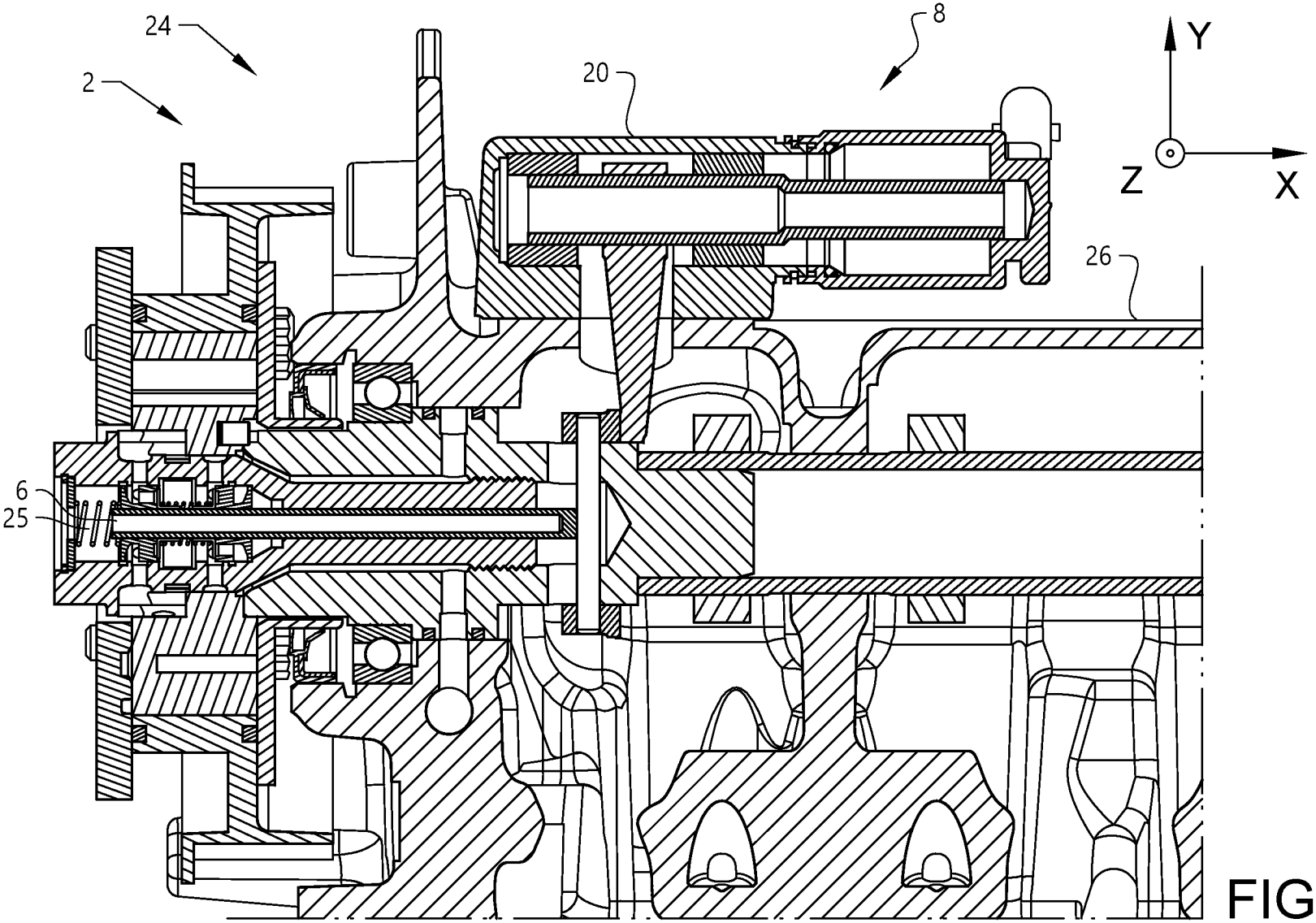

FIG. 3 schematically shows a cross-sectional view of a combustion engine 24 with a camshaft arrangement 1 according to the invention. An oil control valve return means 25 in the form of a spring is arranged at the outside of the oil control valve 6 in order to return the oil control valve 6 from its second position to its first position when the actuator 8 is no longer activated. Alternatively, the actuator 8 is a double acting actuator moving the entire first and second valve actuating configuration in both directions along the camshaft. This requires that the first and second valve actuating configurations are attached to each other.

Further, the actuator 8 is placed outside of the combustion engine 24, in this particular example outside of and on top of a cam cover 26 of the combustion engine 24. The actuator 8 can alternatively be placed away from the cam cover 26 or on a side of the cam cover 26 depending on the design of the combustion engine and the amount of space available in the engine compartment.

Reference signs mentioned in the claims should not be seen as limiting the extent of the matter protected by the claims, and their sole function is to make the claims easier to understand.

As will be realised, the invention is capable of modification in various obvious respects, all without departing from the scope of the appended claims. Accordingly, the drawings and the description thereto are to be regarded as illustrative in nature, and not restrictive.

The invention claimed is:

1. A camshaft arrangement, comprising: a camshaft, a vane-type camshaft phaser attached to a first end of the camshaft, a valve actuating arrangement and an oil control valve, wherein the oil control valve comprises an elongated valve member arranged centrally inside the camshaft, where the elongated valve member can be adjusted in a longitudinal direction of the camshaft so as to control the oil flow to the vane-type camshaft phaser, wherein the valve actuating arrangement comprises a first valve actuating configuration attached to the camshaft and a second valve actuating configuration comprising an actuation arm connected to an actuator, the first valve actuating configuration being arranged to be actuated by the actuation arm of the second valve actuating configuration, thereby adjusting the elongated valve member.

2. The camshaft arrangement according to claim 1, wherein the first valve actuating configuration comprises an actuation ring mounted around the camshaft and an actuation ring member being attached to the actuation ring.

3. The camshaft arrangement according to claim 2, wherein the actuation ring member comprises an actuation pin attached to the actuation ring arranged to run through the camshaft.

4. The camshaft arrangement according to claim 3, wherein the camshaft comprises longitudinal openings for the actuation pin.

5. The camshaft arrangement according to claim 1, wherein the actuation arm comprises an actuation arm member arranged to actuate the first valve actuating configuration.

6. The camshaft arrangement according to claim 5, wherein the actuation arm member comprises a bearing surface adapted to glide against the actuation ring.

7. The camshaft arrangement according to claim 6, wherein the bearing surface is convex.

8. The camshaft arrangement according to claim 5, wherein the angular extension of the actuation arm member is less than 180°.

9. The camshaft arrangement according to claim 5, wherein the actuation arm member is arranged to glide on the camshaft.

10. The camshaft arrangement according to claim 5, wherein the actuation arm member is arranged at a distance from the camshaft.

11. The camshaft arrangement according to claim 5, wherein the actuation arm member comprises a fork.

12. The camshaft arrangement according to claim 1, wherein the oil control valve comprises an oil control valve engagement member arranged to interact with the actuation ring member of the first valve actuating configuration.

13. An internal combustion engine comprising a camshaft arrangement according to claim 1.

14. The internal combustion engine according to claim 13, further comprising a cam cover, wherein the actuator is mounted outside of the cam cover.

15. A vehicle comprising an internal combustion engine according to claim 13.

* * * * *